United States Patent [19]

Garner

[11] 4,250,670

[45] Feb. 17, 1981

[54] METHOD AND ARTICLE FOR USE IN BUILDING CONSTRUCTION

[76] Inventor: Larry Garner, P.O. Box 502, Chapman, Kans. 67431

[21] Appl. No.: 964,900

[22] Filed: Nov. 30, 1978

[51] Int. Cl.[3] ..... E04B 1/68

[52] U.S. Cl. ..... 52/92; 52/169.11; 52/390.7; 52/742; 52/743

[58] Field of Search ..... 52/90, 91, 92, 220, 52/309.1, 309.4, 309.7, 724, 725, 727, 169.11, 309.8, 742, 743; 98/29, 31; 165/53, 56

[56] References Cited

U.S. PATENT DOCUMENTS

| | | | |
|---|---|---|---|
| 1,769,733 | 7/1930 | Bemis | 52/92 X |
| 2,113,875 | 4/1938 | Clark | 52/724 X |
| 2,598,842 | 6/1952 | Scott | 165/56 X |
| 3,037,746 | 6/1962 | Williams | 52/220 X |
| 3,049,067 | 8/1962 | Claude | 98/31 |
| 3,343,474 | 9/1967 | Sohda et al. | 98/31 |
| 3,484,331 | 12/1969 | Betz | 52/309.7 X |
| 3,503,167 | 3/1970 | Mackie | 52/309.7 X |
| 3,563,305 | 2/1971 | Hay | 165/53 X |
| 3,940,893 | 3/1976 | Rausch et al. | 52/90 |
| 4,011,989 | 3/1977 | Diggs | 98/31 X |

*Primary Examiner*—Ernest R. Purser

*Attorney, Agent, or Firm*—Lowe, Kokjer, Kircher, Wharton & Bowman

[57] ABSTRACT

The invention relates to a method of building construction wherein the structural support for the roof of the building is encased in a layer of rigid foam to provide structural support for the roof. The method also contemplates utilizing one or more channel shaped structural members and filling the channel with rigid foam for the purpose of increasing its strength. The method also contemplates providing multiple roof supports and placing a layer of rigid foam between the supports for further structural support. Manifestly, the foregoing method is accomplished through use of a novel form of structural support comprising a channel shaped structural member filled with rigid foam. Two channel members may be placed in face to face or back to back relationship and filled with rigid foam where additional structural support is required.

The present invention also encompasses a novel roof structure wherein the aforedescribed structural supports are formed as an integral part of the roof. By utilizing rigid foam in the roof structure the strength is increased reducing the need for conventional kinds of support.

Finally, the present invention provides for a method of construction of buildings and a method of heating or cooling a building, wherein conduits are incorporated into the walls of the building. The conduits extend beneath the surface on which the building is constructed to a zone where the temperature is relatively constant, notwithstanding temperature changes in the ambient air. This allows the air from the relatively constant temperature zone to pass up through the walls for heat exchange with the building interior. The method of heating or cooling a building may also incorporate a conduit located beneath the floor of the building for the purpose of circulating a heat exchange medium in this area.

13 Claims, 5 Drawing Figures

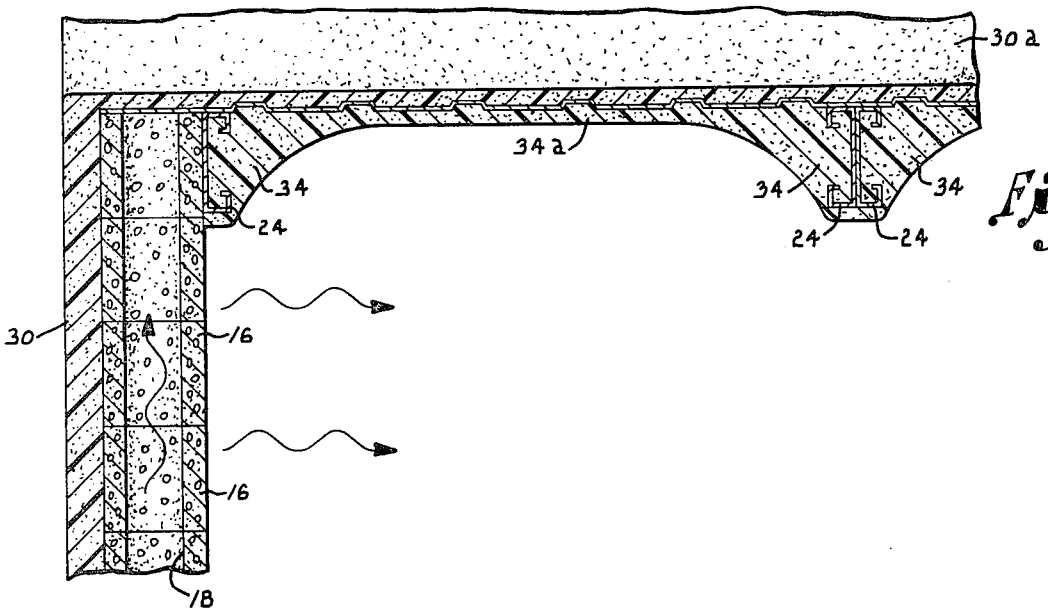
Fig. 3.
Fig. 4.
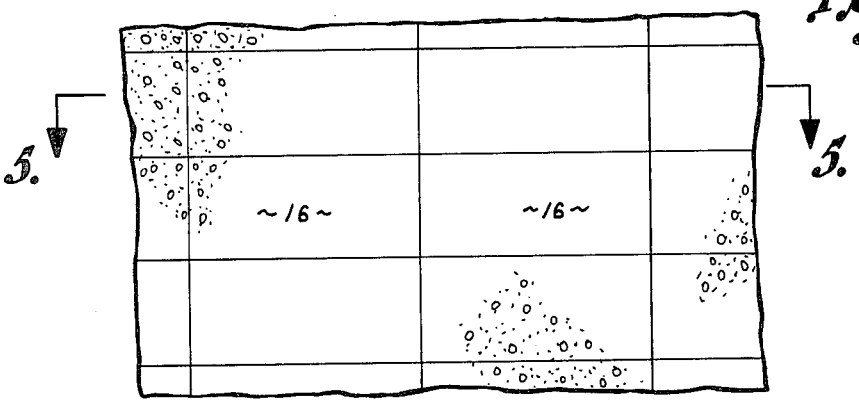
Fig. 5.
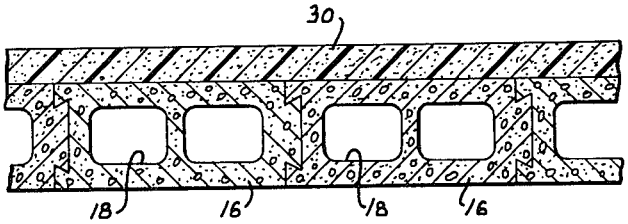

METHOD AND ARTICLE FOR USE IN BUILDING CONSTRUCTION

This invention relates generally to building construction and, more particularly, to a method and article for use in building construction employing rigid foam for structural support.

It is well known in the construction industry to employ cellular materials, commonly referred to as "foam" for insulation purposes. It is also known to take air from beneath the surface of the ground at a level where a relatively constant temperature is maintained and circulate this air inside of a building for purposes of heating or cooling the building.

The present invention utilizes rigid foam for insulation purposes but also for structural support. This allows considerably less structural support of a conventional nature to be employed. The present invention also accomplishes heating or cooling of a building, at least on a supplemental basis, by providing conduits in the walls of the building for transfer of relatively constant temperature air from beneath the surface into the walls for heat exchange purposes.

It is, therefore, a primary object of the present invention to provide a novel type of structural support for use in building construction which employs rigid foam for strength purposes thereby reducing construction costs by reducing the amount of conventional structural support required.

As a corollary to the above object, an important aim of this invention is to provide a method of building construction utilizing a structural support member which derives a portion of its strength from rigid foam.

It is also one of the objectives of this invention to provide a novel roof structure for use in building construction which employs rigid foam as a structural support thereby providing thermal insulation and also reducing the amount of conventional support required.

Another aim of my invention is to provide a method of constructing buildings utilizing conduits in the walls to convey a heat transfer medium which can then be placed in heat exchange relationship with the interior of the building.

As a corollary to the above object, this invention has as an objective to provide a method of building construction wherein conduits in the walls of the building are utilized to place relatively constant temperature air from beneath the surface of the ground into heat exchange relationship with the interior of the building.

It is still another one of the objects of my invention to provide a method of heating or cooling a building through the utilization of conduits placed in the walls which transfer a heat exchange medium, such as air, into a location where it can be utilized for heating or cooling.

Other objects of the invention will be made clear or become apparent from the following description and claims when read in light of the accompanying drawings wherein:

FIG. 3 is another vertical cross-sectional view looking in the direction of line 3—3 of FIG. 1;

FIG. 4 is a fragmentary side elevational view of an interior wall constructed according to the teachings of the present invention; and FIG. 5 is a horizontal cross-sectional view taken along line 5—5 of FIG. 4.

Figure 2:
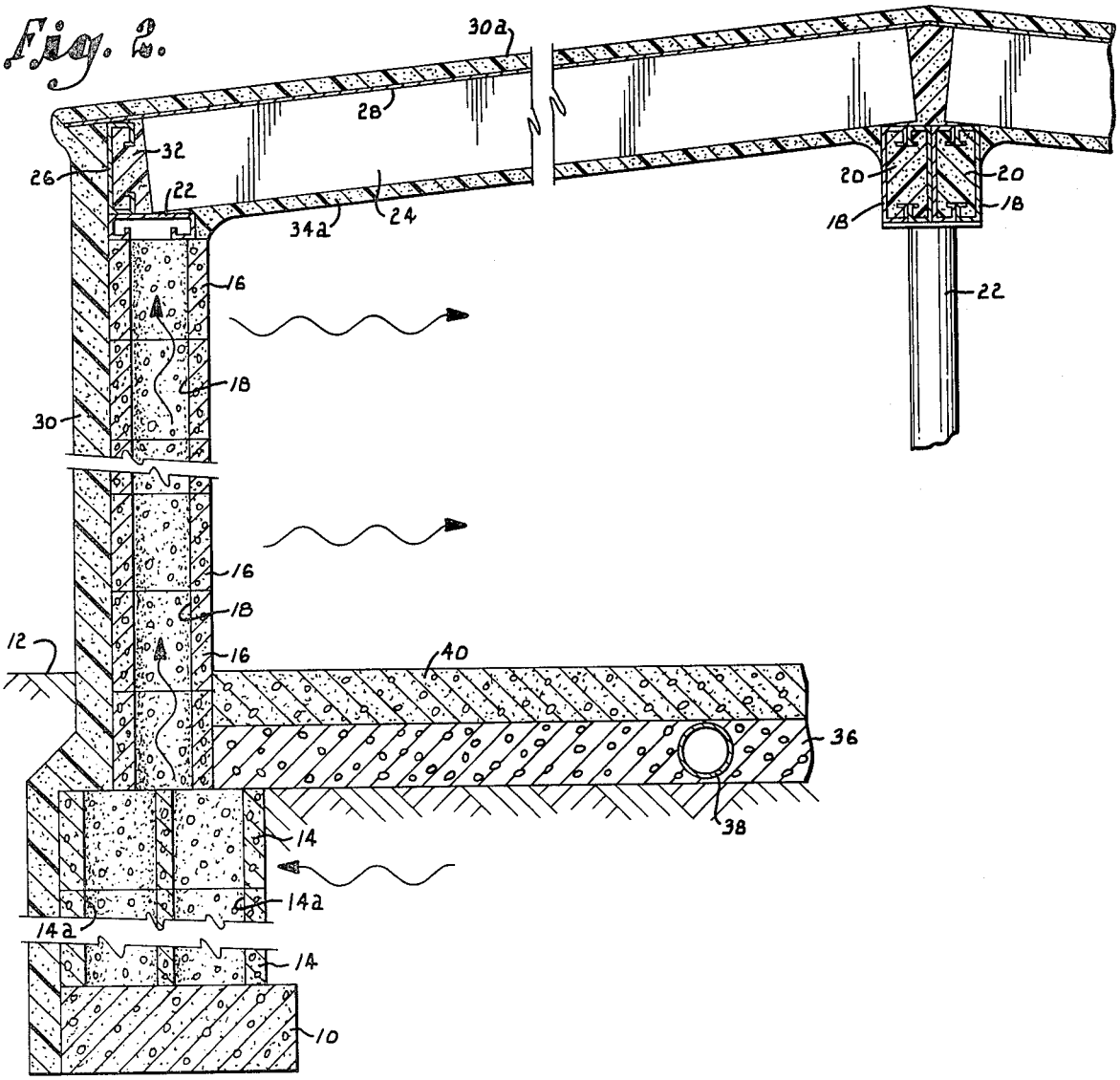
FIG. 2 is a vertical cross-sectional view looking in the direction of the line 2—2 of FIG. 1.

Referring initially to FIG. 2, the first step in constructing a building according to the present invention is to form a concrete footing 10 at a location beneath the ground surface 12. Footing 10 is generally formed of poured concrete and is placed in a zone beneath the surface 12 where the temperature remains relatively constant at all times. This distance varies depending upon the geographical location, but will generally be a minimum of three feet. It will be understood, of course, that footing 10 extends around the entire perimeter of the building to be constructed.

A plurality of concrete blocks 14 are placed on top of footing 10 to form a foundation for the building. A wall is then constructed utilizing a plurality of concrete blocks 16 oriented 90° relative to the orientation of blocks 14.

As best seen from viewing FIG. 5, each of blocks 16 is characterized by a pair of openings 18 and the blocks are arranged in vertical alignment so that the openings 18 in successive tiers are all in vertical alignment. Similarly, the openings 18 in the bottom row of blocks 16 are in alignment communication with openings 14a in foundation blocks 14 (see FIG. 2). The foundation blocks 14 are also disposed with the openings 14a in each respective row in vertical alignment with the openings in the row beneath. It is to be understood that while only one wall has been described in detail the other walls of the building, three in number are similarly constructed.

Referring further to FIG. 2, a center beam structural support is constructed as follows. First and second C-channels 18 are disposed in facing relationship and welded together and the opening therebetween is filled with relatively rigid cellular material 20. Polyurethane is the most commonly used cellular material, but it is to be understood that the present invention is not limited to any particular rigid cellular product. A second pair of C-channels 18 are also disposed in facing relationship, welded, and filled with rigid foam 20. The two pairs of foam filled C-channels are then placed in side by side relationship and supported upon vertical pillars 22 in the manner illustrated.

Another C-channel 22 is placed in inverted position atop two opposed sidewalls presented by blocks 16. Thus, these additional C-channels form a sill for supporting the roof joists.

Roof joists are provided by a plurality of C-channels 24 extending from sill 22 to the center beam presented by C-channels 18. As illustrated FIG. 3, the end joist 24 is connected directly to the adjacent end wall, while the center joists are provided by two C-channels 24 disposed in back to back relationship and welded together. Another C-channel 26 is disposed on top of C-channel 22. C-channel 26 is oriented to present a continuation of the outside wall formed by concrete blocks 16 and form a facia plate around the perimeter of the building. Roof panels 28 are placed on top of the joists formed by C-channels 24 and 26.

Once the structural members are in place the exterior walls and roof are covered with a layer of rigid urethane foam 30. The foam 30 extends downwardly along the foundation presented by blocks 14 to footing 10. That portion of the foam 30 which is on top of roof panels 28 is designated by the number 30a and is of lesser thickness than the layer of foam along the walls. Channel 26 which forms the facia plate is completely filled with foam designated by the numeral 32. Those channels 24 comprising the roof joists are filled with foam material which is designated by the numberal 34. Finally, the inside of roof panels 28 has a relatively thin layer of foam designated by the numeral 34*a*. In this manner the entire structural support for the roof of the building, as well as the roof itself is completely encased in rigid foam which provides supplementary structural support, thereby reducing the amount of conventional support required.

Figure 1:
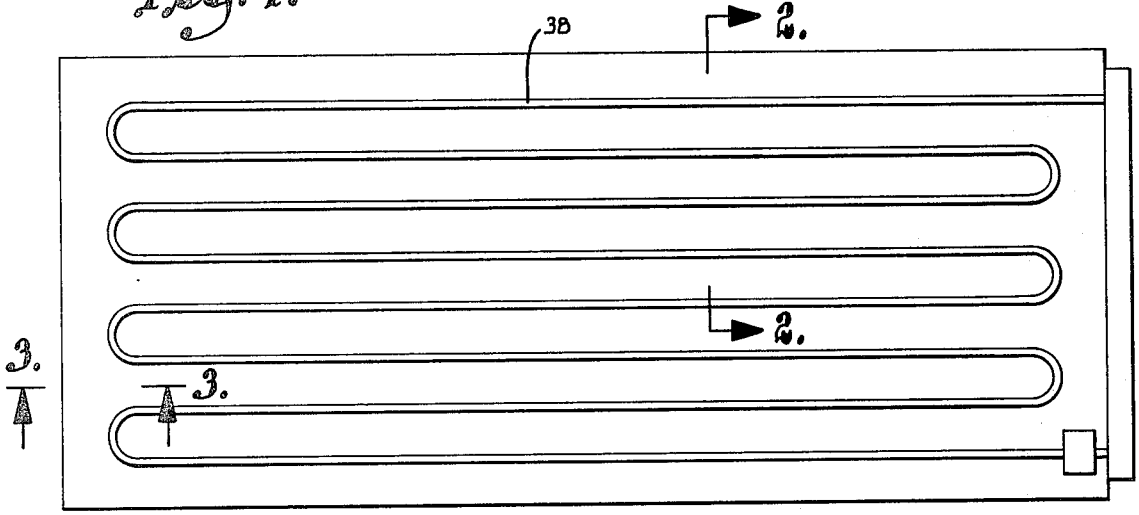
FIG. 1 is a top plan schematic illustration of a building constructed according to the present invention.

The floor of the building is constructed by first providing a layer of several inches of washed gravel 36. Imbedded in the gravel is a conduit 38 which is disposed in serpentine configuration as best illustrated in FIG. 1. On top of the gravel 36 a concrete floor 40 is poured.

With a building constructed as heretofore described, heating of the building is facilitated as a result of the natural conduction of relatively warm air from the constant temperature zone below surface 12 up through the walls presented by block 16. The warm air inside of the blocks is able to undergo heat exchange with the interior walls of the building as indicated by the arrows in FIG. 2. Conduit 38 is utilized to circulate warm water or other heat exchange medium from a solar heater to further facilitate heating of the building. During hot weather, cool water may be circulated in conduit 38 to facilitate cooling of the building.

Another advantage of the method of construction of the present invention is that the utilization of rigid urethane foam between the structural supports not only adds strength and thermal insulation, but avoids the need for expansion joints since the foam inherently has enough flexibility to allow for normal expansion and contraction.

I claim:

1. A method of constructing a building on the ground comprising the steps of:

constructing a rigid footing at a location below the ground surface;

providing a plurality of rigid blocks each having an opening therethrough;

placing said blocks on top of said footing and one another to form walls on top of the footing with the openings of the blocks in registration to present conduits in the walls extending from beneath the ground surface, whereby air from beneath the ground surface flows into said conduits by natural convection and thence into the interior of the building within the walls to thermally affect the interior of the building; and providing a roof on said walls to substantially cover the interior of the building.

2. A method as set forth in claim 1, including the step of blocking the top end of each conduit in the walls to provide a substantially closed path for each conduit terminating adjacent the top ends of the walls, whereby the air flowing in said conduits is directed into the interior of the building.

3. A method as set forth in claim 21, including the step of applying a layer of rigid foam to the outer surface of each wall.

4. In a building, the combination of:

a plurality of walls connected with one another to define an interior region of the building, said walls each being formed by a plurality of rigid blocks placed on top of one another and having openings which register with openings of adjacent blocks to present a plurality of substantially vertical conduits in the walls adapted to receive a flow of air, some of said blocks being disposed beneath the ground surface in a zone wherein the temperature is relatively constant, whereby air from said zone can enter said conduits and flow within the walls and thence into the interior region of the building by natural convection;

a layer of rigid foam on the outside surface of each wall to provide thermal insulation and structural support; and a roof mounted on said walls to substantially cover the interior region of the building.

5. The combination set forth in claim 4, including a first layer of rigid foam on the upper surface of said roof and a second layer of rigid foam on the lower surface of said roof.

6. The combination set forth in claim 4, wherein said blocks are formed of a material such as concrete.

7. The combination set forth in claim 4, wherein said blocks are placed on top of one another in a manner to present cracks between adjacent blocks which are exposed to the interior region of the building to facilitate air flow through said cracks from the conduits into said interior region.

8. The combination set forth in claim 4, wherein said layer of rigid foam is substantially seamless.

9. The combination set forth in claim 4, including means blocking the top end of each conduit to define the conduits wholly within the walls.

10. The combination set forth in claim 4, including a floor structure comprising:

a layer of gravel on the ground within the walls;

a conduit extending through said gravel in a serpentine configuration, said conduit being adapted to receive a heat exchange medium circulated through the conduit; and a rigid floor covering the gravel and extending between the walls.

11. A building structure comprising:

a rigid footing located below the ground surface;

a plurality of walls each formed by a plurality of concrete blocks each having an opening therethrough, said blocks being mounted on said footing and on one another with the openings of the blocks substantially in vertical alignment to present a plurality of generally vertical conduits in each wall, the lower portion of each conduit located below the ground surface in a zone of relatively constant temperature to permit air flow from said zone into the conduits and thence into an interior region of the building by natural convection;

a layer of rigid foam on the outer surface of each wall providing thermal insulation and structural support;

a sill member mounted on top of the uppermost block in each wall to block the top ends of the conduits in the wall, thereby substantially preventing air in said conduits from flowing out the tops of the walls; and a roof mounted on top of the walls.

12. A building structure as set forth in claim 11 including a first layer of rigid foam on an outside surface of said roof and a second layer of rigid foam on an inside surface of said roof.

13. A building structure as set forth in claim 11, wherein said roof includes:

a plurality of beams mounted on top of said walls in extension between a pair of opposed walls to provide roof joists;

a roof panel supported on the walls and said beams;

an outer layer of rigid foam substantially covering the upper surface of said roof panel; and an inner layer of rigid foam substantially covering the lower surface of said roof panel, said inner layer of foam encasing said beams to provide thickened portions of the foam at the beams.

* * * * *